United States Patent [19]

Hebert

[11] 4,230,038

[45] Oct. 28, 1980

[54] MATRIX PRINT HEAD ASSEMBLY

[75] Inventor: Donald G. Hebert, San Ramon, Calif.

[73] Assignee: Helmut Falk, Palo Alto, Calif.

[21] Appl. No.: 809,423

[22] Filed: Jun. 23, 1977

[51] Int. Cl.[3] ..... B41J 3/10; B41J 9/38

[52] U.S. Cl. ..... 101/93.05; 400/124

[58] Field of Search ..... 197/1 R; 101/93.48, 101/93.29–93.34

[56] References Cited

U.S. PATENT DOCUMENTS

| | | | |
|---|---|---|---|
| 3,187,668 | 6/1965 | Marsh | 101/93.34 |
| 3,266,418 | 8/1966 | Russo | 101/93.34 |
| 3,333,667 | 8/1967 | Nordin | 197/1 R |
| 3,459,976 | 8/1969 | Nyman | 101/93.29 |
| 3,587,456 | 6/1971 | Jaensch | 101/93.31 |
| 3,714,892 | 2/1973 | Perry | 101/93.48 |
| 3,828,908 | 8/1974 | Schneider | 101/93.04 |
| 3,994,381 | 11/1976 | Herbert | 101/93.05 |

FOREIGN PATENT DOCUMENTS

| | | | |
|---|---|---|---|
| 1524429 | 8/1970 | Fed. Rep. of Germany | 101/93.48 |
| 2119641 | 11/1972 | Fed. Rep. of Germany | 197/1 R |

*Primary Examiner*—Clyde I. Coughenour

*Attorney, Agent, or Firm*—Bruce G. Klaas; Richard D. Law; Dennis K. Shelton

[57] ABSTRACT

A wire matrix print head assembly in which armatures are mounted between pairs of magnetic pole members and wire printing members with coplanar radially spaced pole member end surfaces facing the direction of movement of the armatures and the wire printing members during printing movement from a non-print position to a print position and the pole member end surfaces providing a first radially innermost pivotal support means engageable with the armature members only during an initial portion of the armature movement and also providing a second radially outermost pivoted support means engageable with the armature members only during a terminal portion of the armature movement.

18 Claims, 6 Drawing Figures

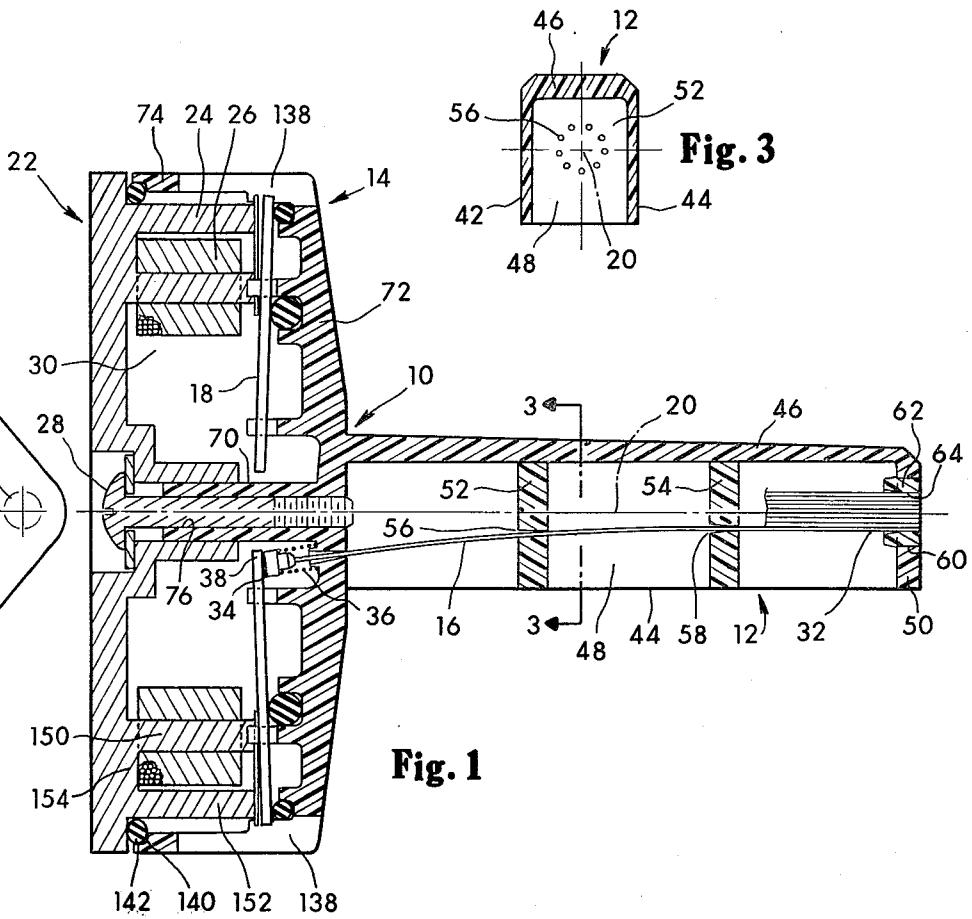
Fig. 1
Fig. 3
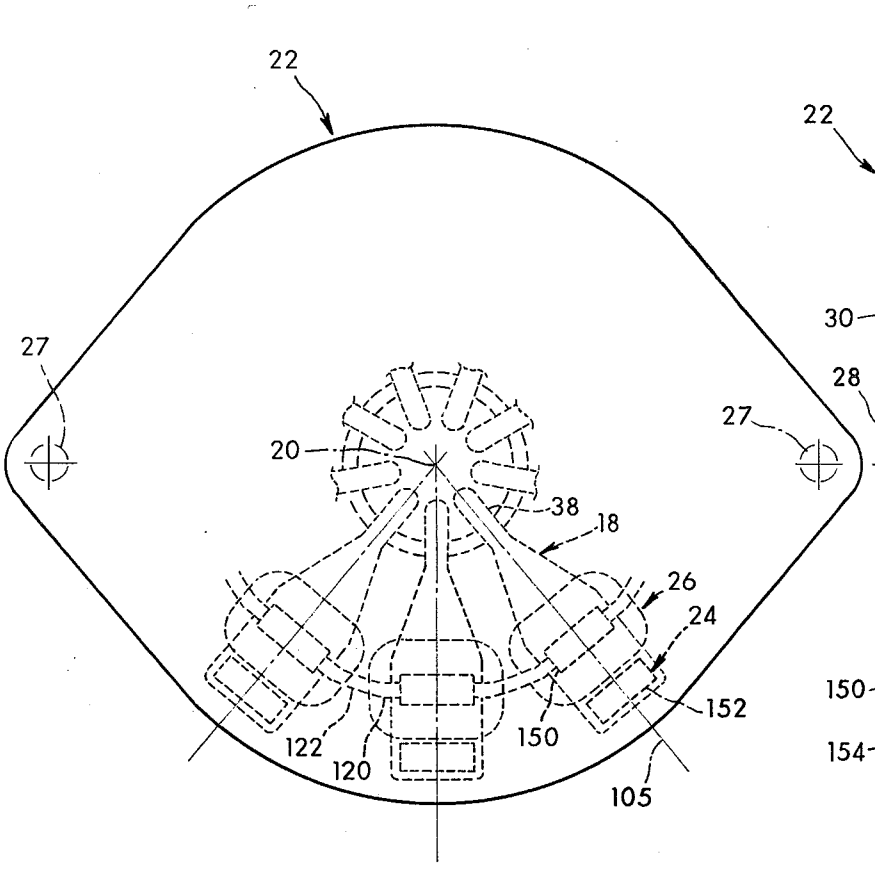
Fig. 2

Fig. 4
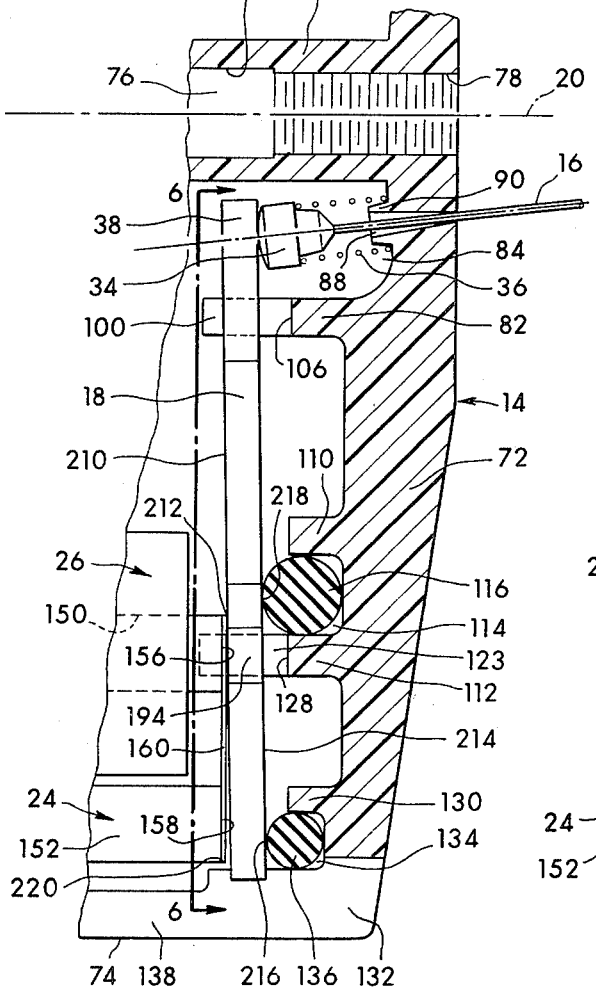
Fig. 5
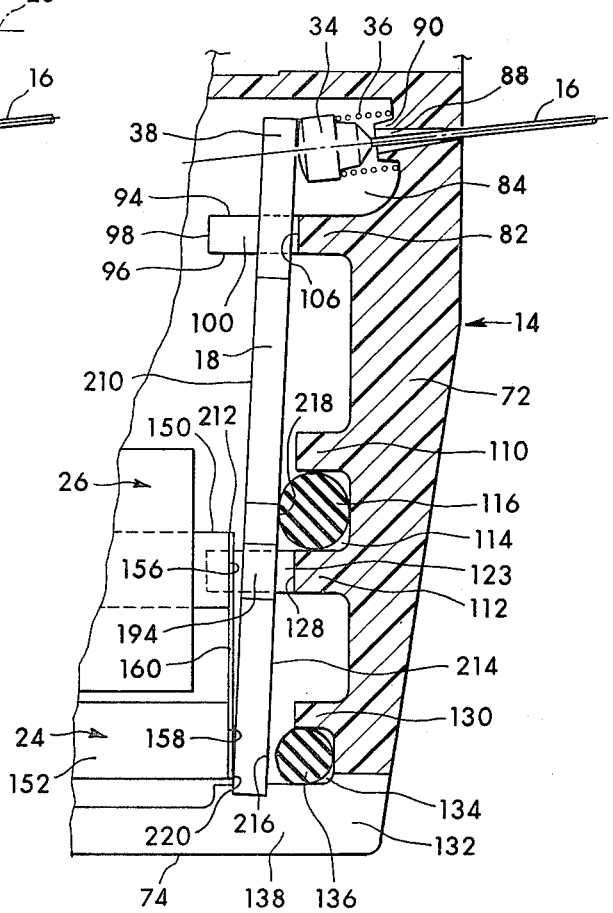
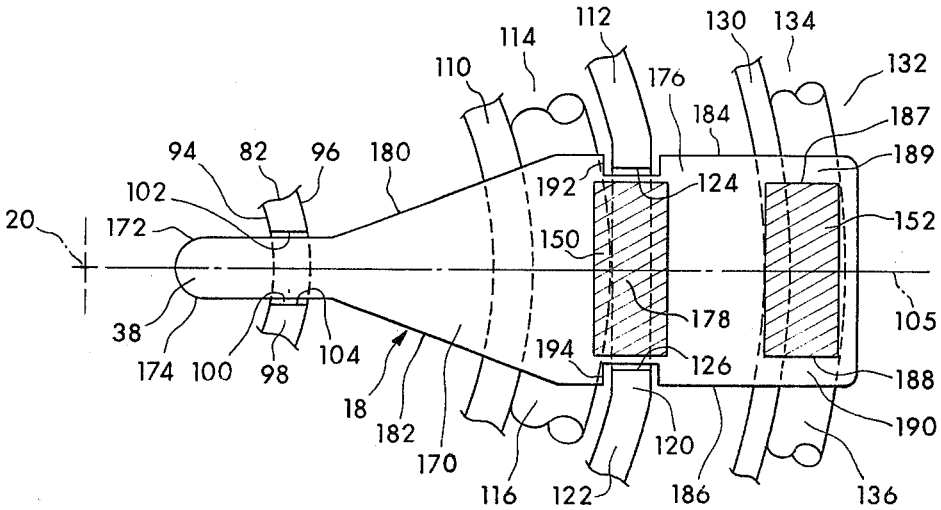
Fig. 6

MATRIX PRINT HEAD ASSEMBLY

BACKGROUND AND SUMMARY OF THE INVENTION

This invention relates to wire matrix print head apparatus of the general type disclosed in prior U.S. Pat. Nos. 3,929,214 and 3,994,381.

In general, this invention provides a wire matrix print head assembly and apparatus which is less costly to manufacture and more reliable in operation while also being more efficient, less noisy, and having higher energy potential than prior art apparatus.

In prior art apparatus, such as that disclosed in the afore-identified United States patents, wire type printing members (stylus or styli) are arranged in spaced relationship about a central longitudinal axis in a generally circular or elliptical matrix for reciprocable movement between a non-print position and a print position with the movement from the non-print position to the print position being of ballistic nature, i.e. by impact and/or driving engagement with another moving member. Each printing member is operatively associated with a radially innermost portion of a radially outwardly extending armature member and ballistically driven thereby by impact therewith during pivotal movement of the armature from a non-print position to a print position. A radially outermost portion of each armature is operatively associated with a radially outwardly located and circumferentially spaced electromagnetic means having radially spaced pole portions including a radially innermost pole portion and a radially outermost pole portion, the pole portions including flat coplanar radially spaced and radially extending end surfaces which face away from the direction of movement from the non-print position to the print position and engaging a side surface of the armature at various times. In the prior art apparatus, the construction and arrangement is such that the armature is pivotally supported at all times on a radially outermost edge of the end surface of the radially outermost pole portion and impacts the end surface of the radially innermost pole portion which is constructed and arranged to cause pivotal movement of the armature from the non-print position to the print position by magnetic attraction. In addition, the construction and arrangement is such that the armature impacts on the end surface of the innermost pole portion at approximately the same time that the printing member is being driven toward the paper. The result is that the kinetic energy of the armature is lost and only the kinetic energy of the printing member is thereafter effective to cause completion of the printing operation. In fact, of the kinetic energy available just prior to impact of the armature with the surface of the pole portion, approximately two-thirds is lost through armature impact with only approximately one-third remaining in the printing member to accomplish the printing operation. The lost two-thirds of the available kinetic energy is simply dissipated upon impact with the surface of the pole portion with resultant high levels of noise and heat. In addition, the speed of the printing process is reduced and the number of sheets of paper which can be printed at one time is also limited. Furthermore, in order to obtain sufficiently high levels of kinetic energy to produce satisfactory printing results, relatively high levels of energy must be used to operate the electromagnetic means.

In the present invention, the armature members and the electromagnetic means are constructed and arranged so that the armature members are normally pivotally supported by a first pivot means on a radially innermost edge of a radially innermost pole portion while being magnetically attracted by a radially outermost pole portion. In addition, the pole portions are constructed and arranged so that the end surfaces thereof face toward the direction of movement of the armature and the printing members from the non-print position to the print position. As a result, the driving movement of the armature continues after impact with the end surface of the outermost pole portion without loss of a substantial portion of the kinetic energy thereof as in prior art apparatus. Furthermore, in the present invention, the construction and arrangement is such that after impact of the armature with the end surface of the outermost pole portion, the first pivot means is disengaged and a second pivotal means is provided between a radially outermost portion of the armature and the radially outermost edge of the radially outermost pole portion whereby the driving movement of the armature may continue substantially unimpeded until completion of the printing operation.

In addition to the foregoing advantages, the present invention further provides for new and improved mounting of the apparatus including the use of housing means made of one piece of molded plastic material which mounts and supports all of the apparatus in a new and improved manner. The electromagnet means comprises a one piece member of sintered powder metallic material providing an end plate having the pole portions integral therewith. Also, the one piece electromagnet member is mounted on the one piece housing means in a manner requiring only one threaded fastening means which may be readily adjusted to vary the axial air gap between the end surfaces of the pole portions and the armature as well as adjusting the armature movement.

BRIEF DESCRIPTION OF DRAWING

The foregoing objectives and advantages are obtained in an illustrative and presently preferred embodiment of the invention shown on the accompanying drawing in which:

FIG. 1 is a cross-sectional side elevational view of a matrix print head assembly;

FIG. 2 is a partial end view of assembly of FIG. 1; and

FIG. 3 is a cross-sectional view taken along the line 3—3 of FIG. 1;

FIG. 4 is an enlarged partial cross-sectional view of a portion of the apparatus of FIG. 1 in a non-print position;

FIG. 5 is an enlarged partial cross-sectional view of the portion of the apparatus of FIG. 4 in a print position; and FIG. 6 is a partial cross-sectional view taken along line 6—6 of FIG. 4.

DETAILED DESCRIPTION

In general, the illustrative print head apparatus comprises a housing means member 10 having an elongated wire stylus guide and support portion 12 and an annular armature housing portion 14 for supporting a plurality of elongated wire stylus print members 16 and an equal number of armature members 18 in equal radially and circumferentially spaced relationship about a central longitudinal axis 20. The print head apparatus further comprises electromagnetic means comprising magnetic plate means 22 for supporting an equal number of armature actuating magnetic pole means 24 and electrical wire coil means 26 located in equally radially and circumferentially spaced relationship about central axis 20 in juxtaposition to and operative relationship with the armature members 18. The magnetic plate means 22, which has a generally elliptical peripheral configuration to provide mounting means 27 for attachment to a printer apparatus (not shown), is secured to the housing means 10 by a fastening means 28 to define an annular chamber 30 in which are mounted the armature members 18, the magnetic pole means 24, and the coil means 26.

In the illustrative embodiment, there are nine wire styli print members 16 of conventional design each including a paper impacting end portion 32 and an impact head portion 34. The wire members 16 are slidably reciprocably movable between a retracted non-print position, FIGS. 1 and 4, and an extended print position, FIG. 5. The wire members are normally located in the non-print position by associated spring members 36 and are movable to the print position by kinetic energy obtained from associated armature members 18. There are nine armature members 18, each including a radially innermost drive head portion 38 mounted in abutting engagement with the impact head portion 34 of the associated wire member 16, which are pivotally supported by and between the associated magnetic pole means 24 and the housing means portion 14 so as to cause pivotal movement of the drive head portion 38 between a rearwardly retracted non-print position, FIGS. 1 and 4, and a forwardly extended print position relative to the wire members 16.

THE HOUSING MEANS

Referring to FIGS. 1 and 3, the housing means 10 is preferably made of one piece of rigid molded plastic material such as glass reinforced temperature resistant Nylon. The stylus guide and support portion 12 of the housing means 10 comprises an elongated portion 40 of generally U-shaped peripheral configuration defined by a pair of spaced side wall portions 42, 44 and a connecting wall portion 46 providing an elongated slot 48 therebetween and an integral end wall portion 50. A plurality of axially spaced wire guide plate members 52, 54, which are preferably made of suitable molded plastic material and have suitably shaped stylus guide holes 56, 58 provided therein in variable radially outwardly spaced relationship to central axis 20, are fixedly mounted in slot 48 in any suitable manner. A central axially extending opening 60 in end wall portion 50 mounts a stylus guide and support member 62, which is preferably made of suitable molded plastic material, with a central opening 64 of generally rectangular cross-section providing nine cylindrical stylus guide and support surfaces, for receiving and supporting the print end portions 32 of the wire members 16.

Referring to FIGS. 1 and 4–6, the housing portion 14 comprises a central axially extending annular hub portion 70, a radially extending annular flange portion 72 and an axially extending annular outer rim portion 74. The hub portion has a central annular bore 76 including a bore portion 78 and an enlarged counterbore 80, FIG. 4 for receiving fastening means 28 in th form of a self-threading self-locking screw member.

A radially innermost annular axially extending first inner rim portion 82 is radially outwardly spaced from hub portion 70 to provide an annular cavity 84 therebetween in which are mounted the drive end portions 38 of the wire members 16 and spring members 36. An equal number of circumferentially spaced tapered wire guide bores 88 are provided in flange portion 72 and extend into cavity 84 through annular spring mounting hub portions 90. The compression spring member 36 is mounted circumjacent the drive end portions of the wire members and hub portions 90 with one end of the spring member abutting a side wall surface of flange portion 72 and the other end abutting a side wall surface of a conventional plastic percussion cap member 34 mounted on the end of the wire member in a conventional manner. Thus, compression spring members 36 provide spring means for biasing the wire members 16 and the armature members 18 toward the retracted non-print position.

The rim portion 82 includes inner and outer axially extending annular surfaces 94, 96 connected by a radially extending annular end surface 98 with radially innermost first armature mounting slot means 100 circumferentially spaced thereabout. Each slot means 100 comprises circumferentially spaced flat parallel side surfaces 102, 104 extending parallel to a radial line 105 and a radially extending flat bottom surface 106 which provide armature guide and support means for guiding and supporting the armature members during movement between the non-print and the print position.

In one embodiment of the invention, a radially intermediate annular axially inwardly extending second inner rim portion 110 is radially outwardly spaced from rim portion 82 and located in juxtaposition to a radially intermediate generally annular axially inwardly extending third rim portion 112 to provide a first annular O-ring groove 114 therebetween in which is mounted a resilient compressible relatively large diameter O-ring member 116 for continuously engaging an intermediate portion of armatures 18.

The rim portion 110, groove 114, and O-ring member 116 are optional and are not necessarily required in practice of the invention. As shown in FIGS. 2, 4–6, the rim portion 112 has a generally polygonal peripheral configuration comprising nine relatively long length circumferentially spaced straight sided rim portions 120 connected by relatively short length straight sided connecting rim portions 122. Each rim portion 120 is centered on and extends transversely relative to the associated one of the radial lines 105. Each rim portion 120 comprises a radially outermost second armature guide and support means centered on and located opposite the coil member 26 in the form of a slot 123 defined by spaced parallel flat side surfaces 124, 126 extending parallel to the associated one of the radial lines 105 and a flat bottom surface 128.

A radially intermediate generally annular axially inwardly extending third inner rim portion 130 is radially outwardly spaced from rim portion 112 and located in juxtaposition to an enlarged portion 132 of the outer rim portion 74 to provide a second annular O-ring groove 34 therebetween in which is mounted a resilient compressible relatively small diameter O-ring 136 for continuously engaging a radially outermost portion of the armatures 18.

An axially and radially outwardly extending slot 138 is provided in the outer rim portion 74 to receive and loosely confine the radially outermost portion of the armature members 18 while also providing for access thereto and for cooling of the magnetic means.

An annular groove 140, FIG. 1, is provided on the inner periphery of the flange portion 74 to receive a resilient compressible O-ring member 142 which is compressibly retained between the magnetic plate means 22 and the pole means 24 and the rim portion 74 by the fastening means 28 in the assembled position.

THE ELECTRO-MAGNETIC MEANS

The plate means 22 and the pole means 24 are preferably made of one piece of sintered powder magnetic material. Each pole means comprises a pair of spaced parallel radially innermost and outermost pole portions 150, 152 of rectangular cross-section, as shown in FIG. 6, and having a connecting base portion 154, FIG. 1, integrally connected to the plate portion or separately attached thereto in any conventional manner. The coil member 26 is mounted on the radially innermost pole portion 150 and axially spaced from the axially outermost parallel surfaces 156, 158, FIGS. 4 and 5, of the pole portions 150, 152. An annular ring 160 of thin film plastic material may be mounted on the parallel coplanar surfaces 156, 158 of each pole portion to provide anti-residual means to enable the rapid return of the armature members to the non-print position without adverse affects of residual magnetism.

THE ARMATURES

Referring now to FIG. 6, each armature member 18 comprises one piece of relatively thin rigid magnetic sheet metal material having a relatively narrow width radially innermost drive head portion 38 with relatively closely spaced parallel side wall portions 172, 174 extending parallel to the radial lines 105. The spacing of side wall portions 172, 174 is slightly less than the spacing of side surfaces 102, 104 of guide slot means 100 so as to enable free sliding relative movement therebetween. A relatively wide radially outermost portion 176 is connected to portion 170 by an intermediate connecting portion 178 having inclined side wall portions 180, 182. Outermost portion 176 has relatively widely spaced parallel side wall portions 184, 186 extending parallel to radial line 105. The spacing of side wall portions 184, 186 is sufficiently greater than the spacing of the adjacent side surfaces 187, 188 of the pole portions 150, 152 so as to provide a substantial surface overlap at 189, 190. A pair of aligned slots 192, 194 are provided along side wall portions 184, 186 and have a rectangular configuration such as to loosely receive the adjacent wall portions of rim portion 120 with the side surfaces of the slots 192, 194 having a spacing slightly greater than the spacing of side surfaces of guide slot means 123 so as to be received therebetween for free sliding movement relative thereto. The side surfaces 184, 186 of the armatures 18 are also dimensioned relative to the side surfaces of the slot means 138 to enable free relative sliding movement therebetween.

The arrangement is such that in the assembled position, each armature 18 is loosely movably mounted in and laterally confined by the slot means 100 and 123 with the compression springs 36 and the outermost O-ring member 136 cooperating to locate the armature member 18 in the non-print position whereat an intermediate portion of the side surfaces 210 of the armatures are pivotally supported by the radially innermost edge surfaces 212 of the radially innermost pole portions 150 as shown in FIG. 4. The diameter of the radially outermost O-ring member 136 is such as to support the armatures only in the non-print position with light compressibly engagement with a radially outermost portion of the side surface 214 of the armatures at 216 as shown in FIG. 4. If the radially innermost O-ring member 116 is utilized it has a diameter such as to only slightly engage a radially intermediate portion of the side surface 214 of the armatures at 218, radially outwardly of the pivotal engagement with pole portion 150 at 212, in the non-print position. Thus, the print head apparatus of the present invention is constructed and arranged such that the armature members 18 are positioned between the electromagnetic means 24, 26 and the wire stylus members 16, which are located on axially opposite sides 210, 214 of the armatures, so that the drive head portions 38 are movable away from the pole portion surfaces 156, 158 rather than toward the surfaces as in prior art apparatus. In addition, first pivotal support means are provided by the radially innermost edge surfaces 212 for pivotally supporting the armatures during a first initial portion of the movement of the armatures from the non-print position to the print position and second pivotal support means are provided by the radially outermost edge 220 for pivotally supporting the armatures during a second terminal portion of the movement of the armatures from the non-print position to the print position. Also, the distance between the first pivotal support means at 212 and the wire members 16 is greater than the distance between the first pivotal support means and the second pivotal support means at 220. In the presently preferred embodiment, the distance between the first pivotal support means and the wire members is approximately 60% of the distance between the second pivotal support means and the wire members.

IN OPERATION

In the non-print position of FIG. 4, a radially innermost portion of the armatures of maximum radial length extends radially inwardly beyond a first pivot means provided by the edge surface 212 of the radially innermost pole portion 150 and a radially outermost portion of the armatures of minimum radial length extends radially outwardly beyond the first pivot means at 212. When the coil members 26 are energized, the magnetic force is effective on the minimum radial length radially outermost portions of the armatures to move those portions toward the pole portion surfaces 156, 158 by pivotal movement about edge surface 212. When the side surfaces 210 of the armatures become parallel with the end surfaces 156, 158 of the pole portions 150, 152, the first pivot means provided by edge surface 212 becomes inoperative and a second pivot means provided by the radially outermost edge surfaces 220 of the pole portions 152 becomes operative to sustain further pivotal movement of the armatures while at the same time increasing the radial length from the effective pivot means to the drive head portions 38. If the O-ring member 116 is utilized, it is resiliently compressed during the pivotal movement from the non-print position to the print position which results in increased frequency response with some loss of kinetic energy of the armatures. When the coil members have been de-energized, the compression springs 36 associated with the wire members 16, the rebound force of the sheets of paper impacted by the wire members, and the compressive force in the innermost O-ring member 116 combine to rapidly return the armature members to the non-print position while at the same time enabling the compression springs 36 and the residual rebound paper force to equally rapidly return the wire membes 16 to the non-print position. Any overtravel of the armatures during the return movement is limited by resilient compressible engagement with the outermost O-ring member 136 to virtually eliminate rebound and noise in operation. It is to be noted that arrangement is such that the return movement is substantially without resistance until the return movement is substantially completed when the side surface 210 of the armature again contacts the inner edge 212 of the inner pole portion 150 and the other side surface 214 again engages the outermost O-ring member 136. It is also to be noted that the arrangement is such that at the time of impact of the wire members 16 with the paper, the outermost pivot means 220 has been established so that maximum leverage is utilized both during printing and during the initial part of the return movement.

The single center connection provided by the threaded fastening means 28 between two relatively rigid parts in combination with the O-ring members enables very fine accurate adjustment of the air gap between the armature members and the pole portions 150, 152.

Thus, a wire matrix print head assembly has been provided which has a weight of approximately 120 grams. The power supply may be between approximately 44 and 52 volts D.C. The coil resistance may be approximately 3.5 ohms at 70° F. The current may be approximately 2.5 amps and the pulse width may be approximately 300 microseconds. The magnetic circuit inductance may be approximately 5 M.H. and the frequency may be approximately 1KC per second. The present matrix print head assembly requires less electrical input energy than prior art apparatus for any given output kinetic energy required for any particular printing operation. The reduction in required present electrical input energy results in greater efficiency, lower heat build-up, and enables higher speed operation. In addition, when necessary or desirable, e.g., to enable printing of relatively large numbers of sheets of paper, the kinetic output energy of the present invention apparatus can be increased to levels beyond those levels available in prior art apparatus.

It is contemplated that the illustrative and presently preferred embodiment of the invention may be variously modified and otherwise constructed, and it is intended that the following claims be construed to include alternative embodiments except insofar as limited by the prior art.

What is claimed is:

1. A matrix print head assembly comprising:

a number of wire stylus members spaced about a central longitudinal axis and being longitudinally movable between a non-print position and a print position;

guide means for movably supporting said wire stylus members;

a number of rigid armature members equal to the number of wire stylus members movable between a non-print position and a print position and extending radially outwardly of and being circumferentially spaced about the central longitudinal axis with a radially inner portion being driveably engageable with said wire stylus members during movement from the non-print position to the print position to drive the stylus members from the non-print position to the print position;

a number of electromagnet means equal to the number of armature members mounted in juxtaposition to a radially outer portion of said armature members for pivotally supporting said armature members during movement from the non-print position to the print position and being selectively energizable for causing pivotal movement of the radially outer portion of said armature members toward said electromagnet means and opposite pivotal movement of the radially inner portion of said armature members away from said electromagnetic means during movement from the non-print position to the print position by magnetic force applied to the radially outer portion;

said armature members being positioned between said electromagnet means and said wire stylus members and said radially innermost portion being movable away from said electromagnetic means toward said wire stylus members during movement from the non-print position to the print position;

first pivotal support means for pivotally supporting said armature members during a first initial portion of the movement of said armature members from the non-print position to the print position; and second pivotal support means pivotally supporting said armature members during a second terminal portion of the movement of said armature members from the non-print position to the print position.

2. The invention as defined in claim 1 and wherein:

said first pivotal support means being spaced outwardly from said wire members and located in juxtaposition to a portion of said electromagnetic means next adjacent said wire stylus members; and said second pivotal support means being located outwardly of said first pivotal support means a further distance from said wire members than the distance between said first pivotal support means and said wire members.

3. The invention as defined in claim 2 and wherein:

said armature members having first and second spaced side surfaces;

the first side surface being located next adjacent said electromagnetic means and engaging said first pivotal support means; and the second side surface being located next adjacent and engaging said wire members.

4. The invention as defined in claim 3 and wherein:

said electromagnetic means comprising a first pole portion and second pole portions being spaced from one another, the first pole portion being next adjacent said wire members, the second pole portion being spaced outwardly of said first pole portion a distance further away from said wire members than the distance between said first pole portions and said wire members, and the second pole portion being effective to actuate said armature members from the non-print position to the print position;

said first pivotal support means comprising an innermost edge surface of said first pole portion next adjacent said wire members; and said second pivotal support means comprising an outermost edge surface of said second pole portion furthest outwardly spaced from said wire members.

5. The invention as defined in claim 4 wherein:

the distance between first pivotal support means and said wire members being greater than the distance between said first pivotal support means and said second pivotal support means.

6. The invention as defined in claim 5 and wherein:

the distance between said first pivotal support means and said wire members being approximately 60% of the distance between said second pivotal support means and said wire members.

7. The invention as defined in claim 4 and further comprising:

first guide slot means located next adjacent wire members and located between said wire members and said first pivotal support means for guidably supporting said armature members during movement between said non-print position and said print position.

8. The invention as defined in claim 7 and further comprising:

second guide slot means located outwardly of said first guide slot means and outwardly of said first pivotal support means for guidably supporting said armature members during movement between said non-print position and said print position.

9. The invention as defined in claim 8 and further comprising:

a first resilient compressible support means for engaging said armature members only in the non-print position and being located outwardly of said first pivotal support means and between said first pivotal support means and said second pivotal support means.

10. The invention as defined in claim 9 and wherein:

said first resilient compressible support means comprising an O-ring member having circumferentially spaced portions engageable with said armature members.

11. The invention as defined in claim 10 and further comprising:

a second resilient compressible support means for engaging said armature members inwardly of said first resilient compressible support means opposite said first pivotal support means and for applying a force to said armature members opposite to the direction of movement of said armature members from the non-print position to the print position.

12. The invention as defined in claim 11 and wherein:

said second resilient compressible support means comprising an O-ring member having circumferentially spaced portions in constant engagement with said armature members.

13. The invention as defined in claim 9 and further comprising:

a molded plastic housing means for supporting said wire members and said armature members and said electromagnetic means;

said housing means comprising a flange portion and a rim portion defining a cavity containing said armature members and said electromagnetic means;

said armature members extending generally parallel to said flange portion and being located in juxtaposition thereto;

said electromagnetic means extending generally parallel to said rim portion and being located in juxtaposition thereto; and said first guide means and said second guide means being integrally formed on said flange portion.

14. The invention as defined in claim 13 and further comprising:

a first O-ring groove being integrally formed in said flange portion for receiving said first resilient compressible support means.

15. The invention as defined in claim 14 and wherein said electromagnetic means comprising:

a magnetic plate member extending parallel to said flange portion;

fastening means for connecting said plate member to said housing means;

a number of pairs of magnetic pole members equal in number to said armature members mounted on said magnetic plate member and extending into said cavity; and an electrical coil member mounted on each of said pairs of magnetic pole members within said cavity.

16. The invention as defined in claim 15 and wherein:

said magnetic plate member and said magnetic pole members being made of one piece of sintered metallic powder material.

17. The invention as defined in claim 16 and wherein:

said fastening means being adjustably connected to said housing means for varying the location of said electromagnetic means relative to said flange portion.

18. The invention as defined in claim 17 and further comprising:

a resilient compressible O-ring member mounted between and compressibly engageable by said magnetic plate member and said rim portion for resiliently compressibly supporting said magnetic means relative to said flange portion.

* * * * *

UNITED STATES PATENT AND TRADEMARK OFFICE

CERTIFICATE OF CORRECTION

PATENT NO. : 4,230,038

DATED : October 28, 1980

INVENTOR(S) : Donald G. Hebert

It is certified that error appears in the above-identified patent and that said Letters Patent are hereby corrected as shown below:

On the cover page, column 1, "Assignee: Helmut Falk, Palo Alto, Calif." should read -- Assignee: Helmut Falk, Palo Alto; Donald G. Hebert, San Ramon, both of Calif., part interest --.

Signed and Sealed this

*Eleventh* Day of *August 1981*

[SEAL]

*Attest:*

GERALD J. MOSSINGHOFF

*Attesting Officer*

*Commissioner of Patents and Trademarks*